United States Patent [19]

Baldi

[11] 3,958,046

[45] May 18, 1976

[54] COATING FOR CORROSION RESISTANCE

[75] Inventor: Alfonso L. Baldi, Drexel Hill, Pa.

[73] Assignee: Alloy Surfaces Co., Inc., Wilmington, Del.

[22] Filed: Feb. 27, 1974

[21] Appl. No.: 446,473

Related U.S. Application Data

[63] Continuation-in-part of Ser. Nos. 219,514, Jan. 20, 1972, Pat. No. 3,801,357, Ser. No. 304,220, Nov. 6, 1972, Ser. No. 357,616, May 7, 1973, Ser. No. 404,665, Oct. 9, 1973, said Ser. No. 219,514, is a continuation-in-part of Ser. No. 837,811, June 30, 1969, abandoned, and Ser. No. 90,682, Nov. 18, 1970, Pat. No. 3,764,371, said Ser. No. 90,682, is a continuation-in-part of Ser. No. 837,811, said Ser. No. 304,220, Ser. No. 357,616, and Ser. No. 404,665, each is a continuation-in-part of Ser. No. 254,403, May 18, 1972, Pat. No. 3,785,854, and Ser. No. 90,682.

[52] U.S. Cl. ..... 427/252

[51] Int. Cl.[2] ..... C23C 11/02

[58] Field of Search ..... 117/107.2 P; 427/252

[56] References Cited

UNITED STATES PATENTS

| | | | |
|---|---|---|---|
| 2,887,420 | 5/1959 | Llewelyn | 117/107.2 P |
| 2,955,957 | 10/1960 | Dorner | 117/102.7 P |
| 3,286,684 | 11/1966 | Aves | 117/102.7 P |
| 3,690,934 | 9/1972 | Galmiche et al. | 117/107.2 P |
| 3,764,373 | 10/1973 | Speirs et al. | 117/102.7 P |
| 3,867,184 | 2/1975 | Baldi et al. | 117/107.2 P |

*Primary Examiner*—Cameron K. Weiffenbach
*Assistant Examiner*—R. Eugene Varndell, Jr.
*Attorney, Agent, or Firm*—Connolly and Hutz

[57] ABSTRACT

Aluminum coatings to reduce corrosion of steels and the like, are very effective when applied by pack diffusion below 1000°F using a retort cup not over fifteen inches high, with anhydrous or hydrated energizer in a layer on top of the pack and out of contact with the workpieces. Such diffusion coatings are more uniform than corresponding coatings made with the pack energizer in a set of porous containers imbedded in the pack, even when using a retort not over 15 inches high and the porous containers are grouped together separately from all the workpieces. Keeping workpieces away from above and below the porous containers helps. Aluminum diffusion can also be effected from continuous coatings of leafing-type aluminum particles and such leafing coatings in very thin layers are more effective than coatings of non-leafing aluminum, with or without diffusion. The leafing aluminum coatings can be sprayed on from aqueous dispersion containing wetting agents and if desired a polyethylene glycol to help disperse the aluminum, as well as mixtures of phosphoric acid, chromic acid and magnesium, aluminum, calcium or zinc salts of these acids. A protective second coating of such mixtures can be applied as a cover layer over the layer containing the leafing aluminum, and this combination works best on a ferrous metal that has an aluminum diffusion coating, particularly a ferrous metal that contains less than 1% chromium and has such an aluminum diffusion coating. It also works very well on aluminum diffusion coatings from packs containing chromium, or chromium and silicon, in addition to the aluminum, and these alloys can be made by magnesothermic reduction of their mixed oxides or the like.

6 Claims, No Drawings

COATING FOR CORROSION RESISTANCE

CROSS REFERENCE TO RELATED APPLICATION

The present application is a continuation-in-part of application Ser. Nos. 219,514 filed Jan. 20, 1972 (U.S. Pat. No. 3,801,357 granted Apr. 2, 1974); 304,220 filed Nov. 6, 1972; 357,616 filed May 7, 1973; and 404,665 filed Oct. 9, 1973. The first of this set of four applications is a continuation-in-part of application Ser. No. 837,811 filed June 30, 1969 (subsequently abandoned) and of application Ser. No. 90,682 filed Nov. 18, 1970 (now U.S. Pat. No. 3,764,371 granted Oct. 9, 1973). The last three of that set of four applications are each continuations-in-part of application Ser. No. 254,403 filed May 18, 1972 (now U.S. Pat. No. 3,785,854 granted Jan. 15, 1974) and of application Ser. No. 90,682 filed Nov. 18, 1970 (now U.S. Pat. No. 3,764,371 granted Oct. 9, 1973). Application Ser. No. 90,682 is in turn a continuation-in-part of application Ser. No. 837,811.

BACKGROND OF THE INVENTION

This invention relates to the coating of metals to improve their use, particularly in resisting corrosion.

SUMMARY OF THE INVENTION

Among the objects of the present invention is the provision of novel coating methods and compositions, as well as novel coated metals, that are simple to use or manufacture and are highly effective.

The foregoing as well as additional objects of the present invention will be more fully understood from the following description of several of its exemplifications.

According to the present invention, very high quality aluminum pack diffusion coatings are produced on ferrous metal workpieces at temperatures below 1000°F when using an aluminum halide energizer, if the energizer is applied as an upper layer over the diffusion coating pack and the pack is held in a retort cup not over 15 inches deep. Also better results are obtained when the energizer is kept out of contact with the workpieces in the pack, notwithstanding the discosures in U.S. Pat. Nos. 3,096,160 and 3,764,373 that such energizer be mixed throughout the pack or be inserted in hollows in the workpieces.

The aluminum halide energizers suitable for use in the foregoing process are the chloride, bromide and iodide, and they can be either in anhydrous or hydrated forms. The hydrated forms can be fully or partially hydrated.

A very effective technique for carrying out the foregoing diffusion coating is to pack a 15 inch deep retort cup to within about 1-½ to 2 inches of its top with energizer-free pack that has been previously used for such coating and with workpieces, then cover that pack with a layer about 1 inch think of energizer-free pack powder not containing workpieces, then over that layer sprinkle a thin stratum of energizer in an amount that provides about 0.2 to about 2% of the water-free portion of the energizer by weight of the entire pack used (not including the workpieces), and then cover the energizer stratum with another layer of pack powder or with a loosely fitting metal retort cover or both. This technique makes it unnecessary to follow the usual practice of mixing the energizer with the pack powder, thus saving a process step and simplifying the processing. This saving and simplification are effected with both freshly prepared packs and reused packs. Such packs for use at the low processing temperatures of the present invention can simply be undiluted aluminum powder, in which case no pack powder mixing at all is needed. The aluminum powder can if desired be diluted with up to as much as 50 times its weight of an inert filler such as alumina powder, in which event additional aluminum can be mixed into the pack every time it is reused to make up for the alminum consumed aluminum the coating and thus keep the pack composition more or less uniform through successive coating runs. Preferred packs contain 10 to 40% by weight aluminum.

During the diffusion coating the coating pack tends to become lumpy in those portions containing energizer, and instead of breaking up those lumpy portions for reuse, they can merely be discarded. Thus the top half inch of pack can be removed and discarded after each run.

If desired make-up aluminum or make-up pack mixture can be added as or to one or both of the pack-covering layers only, so that it is out of contact with the workpieces but is automatically mixed with the pack powder when a retort is emptied after a run. In such a modification the lumpy portions of the pack are preferably crushed and reused.

If desired a fine (e.g. 200 mesh) screen of aluminum, steel, stainless steel or aluminized steel, or other ferrous metal, can be used under the energizer layer to help keep particles of energizer from working their way into the pack. It is not necessary to keep the energizer from contacting the retort walls as suggested in U.S. Pat. No. 3,286,684.

As pointed out above, when using hydrated energizer, provision is made for the fact that the water content of the energizer can be almost half the total weight of the energizer and that such water does not contribute to the energizer function. In general the amount of aluminum halide in accordance with the present invention is about the same as generally used, if its water content is discounted.

It is preferred that the energizer be at least ¼ inch away from the workpieces in the pack, and separations of as much as one inch are even better. However still greater separations do not contribute any further advantages.

The following example is a particularly practical embodiment of the present invention.

EXAMPLE I

Into each of four plain carbon steel retort cups 2 feet wide and 14 inches high is poured a powder pack consisting of 20% aluminum by weight and 80% alumina, both minus 325 mesh and uniformly mixed together. After the retort bottoms are covered with about ½ inch of powder, jet engine compressor vanes made of martensitic stainless steel are laid over the powder layer, the vanes being spaced about ⅛ inch apart. This layer of vanes is then covered with more powder till the powder is about ½ inch above the vane tops, and another layer of vanes is then laid down and the layering repeated until the engine packing is 12-½ inches deep in each retort. More pack powder is then added to each to assure there is about 1 inch of powder above the tops of the topmost vanes, following which there is sprinkled over each a very thin stratum of crystalline $AlCl_3.6H_2O$ in an amount weighing 0.6% of the total powder weight. The retorts are then filled to their tops with additional pack powder, and they are stacked one above the other on the floor of a gas-fired bell furnace. The stacking does not steal any of the retorts shut. The top of the furnace equipped with gas inlet and outlet flush lines, is lowered over the stack and sealed against the furnace floor, and a slow flow of argon gas is passed through the furnace interior to start flushing out the air within it. After the argon purge, hydrogen is substituted for the argon, and is introduced at a rate that permits it to be burned with a small flame as it emerges from the end of the outlet tube. Only a very low flow rate is necessary, about 10 to 15 standard cubic feet per hour.

The heating of the furnace is started at a rate of about 1.5°F per minute, as measured by thermocouples in each retort and connected to external meters, and when the thermocouples reach 300°F the flow of hydrogen can be reduced so that the outlet flame is very tiny. At this point the hydrogen inflow can be less than 10 standard cubic feet per hour.

As the heating up continues, the temperatures indicated by the thermocouples increase uniformly and gradually and chemical vapors begin to appear in the burning outlet gas. By the time the thermocouple temperatures reach about 450°F, the discharge of chemical vapors has subsided, the gas flow continuing till the temperatures reach 850°F where the furnace heating is set to hold.

After 16 hours at 850°F, the furnace heating is terminated and the furnace permitted to cool until the thermocouple temperatures reach 300°F. The atmosphere in the furnace is then purged by switching the inflow gas to argon or nitrogen and the furnace shell then removed from the retorts, permitting the retorts to cool further in air. The contents of the retorts are then poured out from them, and the vanes thus recovered show very uniform pick-up at about 2.8 milligrams per square centimeter of vane surface, as well as a case depth of about 0.4 mil. After water washing and drying a light blasting with fine glass particles propelled by an air stream supplied at 5 to 10 pounds per square inch can be used to clean the coated vanes and make them ready for use or for additional protective coating as described in applications Ser. No. 357,616 and Ser. No. 404,665.

The same coating results are obtained when the packed retorts are enclosed in an outer retort within the furnace, as described for instance in U.S. patent application Ser. No. 219,514. Also the gas inflow can be argon throughout the entire process and this will not materially affect the coating although the pack may then be less suitable for reuse in another allargon-bathed coating. Reuse in a hydrogen-bathed coating restores the pack to full effectiveness. For an all-argon-bathed coating the argon inflow can be at an exceedingly low rate since it does not burn and no minimum flame-maintaining rate is needed. The argon flow is readily monitored by having the gas outflow tube in the shape of a manometer and containing water through which the outflowing argon bubbles as slowly as desired. Indeed so long as the manometer shows a little superatmospheric pressure within the furnace no outflow bubbling at al is needed. During heat-up thermal expansion and vapor formation cause gas outflow even when there is no inflow of gas so that little or no gas inflow is needed until the furnace approaches its maximum temperature.

Further operable modifications include the substitution of helium or other inert gas for some or all of the argon, the conducting of the diffusion coating in a glass-sealed retort as described in U.S. Pat. No. 3,096,160, as well as the use of a somewhat loosely gasketed retort closure as described in U.S. Pat. No. 3,764,373. With those types of retort arrangements the energizer should be anhydrous.

The aluminum particles used in the foregoing process can be of widely varying size, from as large as one millimeter to as small as 2 microns. The smaller sized particles should be carefully handled inasmuch as they tend to be pyrophoric until they are mixed with filler. On the other hand the larger sized particles are slower in effecting the diffusion coating, particularly when diluted with inert filler. The preferred size range is from about 5 microns to 100 microns.

As indicated above, inert fillers other than almina can be used in the foregoing packs, and kaolin is such an alternate, as is magnesia. While the fillers are not consumed during the coating treatment, some of the coating pack is generally lost during handling particularly when separating out the coated workpieces, and when the pack contains filler it is desirable to replenish the pack with some filler as well as with fresh aluminum. Such replenishing can be confined to the cover layers of powder on the pack retort, where pre-mixing of the replenisher with the entire pack is not desired. It is also helpful, unless the pack contains less than 10% filler, to subject a brand new pack to a break-in heat with no workpieces.

The aluminizing process of the present invention is applicable for coating any ferrous base metal such as cast iron, plain carbon steels, low alloy steels, martensitic stainless steels and other stainless irons and steels including age-hardening stainless steels, and it is particularly desirable for rendering corrosion-resistant those ferrous alloys containing at least 1% chromium and preferably at least 5% chromium. Martensitic stainless steels such as type AISI 410 or AISI 403 stainless steel, greek ascology and age-hardening stainless steels such as 17-4 PH and 17-7 PH steels are typical examples of alloys with which the aluminizing of the present invention effects a striking increase in corrosion resistance at temperatures as high as 1100°F, such as encountered in the compressor section of a jet engine flying through salty environments close to the sea. Aluminum pick-ups of about ½ to about 7.5 milligrams per square centimeter are particularly effective for this purpose, and for plain carbon steels or steels with not over 1% chromium, as much as 8 milligrams per square centimeter are desirable. Where the ferrous substrate contains less than 1% chromium, it can be chromium plated before the aluminum diffusion and thus improve the increase in corrosion resistance. Ferrous metal refers to metals containing at least 50 weight percent iron.

The retorts in which the alminum diffusion coating is carried out can be made of any material, such as steels that stand up under the coating conditions. The surfaces of the retorts will acquire an aluminum diffusion coating during use, but this does not unduly weaken the steel and does not interfere with the coating. Indeed an aluminum surface on the retort is desirable inasmuch as it does not take on much more aluminum during the coating run and thus does not remove much aluminum from the pack. A break-in heat of the pack in a virgin retort is therefore helpful. It is preferred that the retort metal not include any low melting metal such as zinc, lead, antimony, bismuth and tin.

The corrosion resistance of the foregoing chromium-containing metal can also be increased by aluminum coating that is applied by other methods such as shown in U.S. Pat. No. 3,787,305 granted Jan. 22, 1974. The increased protection thus obtainable from layers of less than about 1 milligram per square centimeter, is greatly improved if the aluminum coating is effectively continuous over the surface being protected, a result that is obtained when leafing-type aluminum particles are applied in amounts that permit the individual aluminum flakes to partially overlap each other over the entire surface being protected. It is also helpful, as suggested in U.S. Pat. No. 3,787,305, to subject the aluminum-coated ferrous member to a temperature that causes at least a little bit of the aluminum to diffuse into the ferrous surface.

Leafing-type aluminum particles can be made as described in U.S. Pat. No. 2,312,088, and are generally characterized by the presence of stearic acid or aluminum stearate or the like as a very thin coating on the surface of the aluminum particle, a condition which makes it extremely difficult to disperse such aluminum particles in water. A substantial amount of wetting agent will effect a suitable dispersion, although it is easier to effect such dispersions by also adding diethylene glycol or triethylene glycol or more highly polymeric ethylene glycol having a molecular weight up to about 9000, as described in U.S. Pat. No. 3,318,716 granted May 9, 1967. As shown in that patent, very effective dispersions of leafing-type aluminum can be made from a concentrate that consists essentially of the leafing aluminum, the polymeric ethylene glycol and a wetting agent, the aluminum being present in an amount about ¼ to about 1-½ parts by weight for every part of the polymeric ethylene glycol by weight, and the wetting agent concentration from about 5% to about 25% by weight of the concentrate.

The foregoing concentrate readily mixes with water in all proportions to provide an aqueous dispersion of almost any desired aluminum content. Thus a diluted dispersion containing 5% aluminum, 6% hexa-ethylene glycol and 0.7% para-n-octyl phenyl ether of decaethylene glycol, is readily sprayed onto a stator ring of a jet engine compressor to leave a coating weighing 0.5 milligram per square centimeter after drying in air to evaporate most of the water. The stator thus coated is then heated in an air oven until its temperature reaches 800°F. The heating first causes the glycol and wetting agent to be volatilized off leaving a very adherent continuous and shiny coating that resembles polished aluminum and significantly adds to the corrosion resistance of the stator ring even if the heating temperature goes no higher than 600°F. The increase in corrosion resistance becomes more significant when the heating carries the coating to temperatures of about 900°F, where some diffusion of the aluminum into the ferrous surface of the stator begins. The rate of diffusion and the degree of resulting corrosion resistance is further increased by confining the coated stator in an atmosphere of gaseous aluminum chloride while it is at temperatures above about 700°F. The aluminum chloride atmosphere is conveniently provided by a pack treatment as described in Example I but with no aluminum in the pack. However the stator ring containing the leafing aluminum coating can merely be hung on a wire in a retort containing a little energizer and no pack, and fired in this way in an otherwise inert atmosphere.

Other aluminum halides such as aluminum bromide and aluminum iodide also behave like aluminum chloride and indeed other well known energizers for low temperature aluminum diffusion coatings can be used instead of the aluminum halides with corresponding results. A list of such energizers is given in application Ser. No. 357,616.

The leafing-type aluminum particles used in the above connection are preferably from about 50 to about 250 microns in maximum size although other sizes can also be used.

Non-ionic wetting agents are preferred for dispersing the aluminum inasmuch as such wetting agents are more readily driven off by high temperatures. However other types of wetting agents, including those that are not driven off or not completely driven off, at 600° to 900°F, can be used. Making the aluminum coatings heavier than about 4 milligrams per square centimeter does not add anything significant to the corrosion resistance, and as little as 0.10 milligram per square centimeter is helpful although at least about 0.3 milligram per square centimeter is preferred.

The application of a leafing-type aluminum coating also improves the corrosion resistance of ferrous surfaces that contain less than 1% chromium, particularly when such surfaces have a diffusion coating of aluminum. The leafing aluminum coating also improves the corrosion resistance of a coating obtained from mixtures of aluminum particles with phosphoric acid, chromic acid and magnesium, aluminum, calcium or zinc salts of these, as described in U.S. Pat. No. 3,248,251 granted Apr. 26, 1966. Thus substituting the leafing aluminum, along with sufficient wetting agent and with or without the polymeric ethylene glycol, for the spherical aluminum in the formulations described in that patent contributes a significant increase in corrosion resistance, particularly in cured layers weighing not more than about 1 milligram per square centimeter. In such mixtures firing of an alminum-containing coating does not effect significant diffusion of aluminum into a ferrous substrate so long as the firing temperature is not over 1000°F. Above that temperature the firing tends to adversely affect ferrous metals, particularly those used in jet engine compressor sections.

Another feature of the use of leafing-type aluminum is the improved appearance that the workpieces are given. Substituting this type of aluminum for that shown in the composition of Example I in U.S. Pat. No. 3,248,251 with the help of the foregoing polyglycol-wetting agent formulation, not only gives a product having somewhat better corrosion resistance, but with a bright aluminum sheen. During the heating of the new compositions to cure them, fumes are given off, indicating that the poly glycol and the wetting agent are being volatilized away, and no significant reduction of the hexavalent chromium to trivalent condition seems to take place.

The foregoing improvements in corrosion resistance and in appearance are also obtained when the last-mentioned coating is covered by a similar coating, even one that does not contain metallic aluminum. Such top coating are described in applications Ser. No. 357,616 and Ser. No. 404,665, and the contents of those applications are hereby incorporated in the present application as though fully set out herein. However, multiple coating layers each of which contains metallic aluminum are very effective, particularly when each layer weighs between 0.1 and 0.5 milligrams per square centimeter.

As shown in the aforementioned applications, the proportions of the ingredients in the chromic acid-phosphoric acidsalt coating mixture can range as follows:

| | | |
|---|---|---|
| Chromate ion | 0.2 to 1, | preferably 0.4 to 0.8 mols per liter |
| Phosphate ion | 0.7 to 4, | preferably 1.5 to 3.5 mols per liter |
| Magnesium ion | 0.4 to 1.7, | preferably 0.9 to 1.4 mols per liter |
| Resin (where used) | 2 to 14, | preferably 3 to 10 grams per liter |

The magnesium ion can be replaced by any of the other ions referred to above, in the same concentrations.

Instead of directly applying such an overlying coating whether or not it contains metallic aluminum, it can be applied after an intervening coating of colloidal alumina or the like weighing about 0.1 to about 1 milligram per square centimeter, also as described in applications Ser. No. 357,616 and Ser. No. 404,665, with increases in corrosion resistance as described in those patent applications. With or without such an intervening coat, the final cured article has a golden sheen that is extremely attractive and quite adherent. The presence of polytetrafluoroethylene particles in the phosphoric acid-chromic acid-salt mixtures of either or both of such layers is also helpful, as described in the last-mentioned applications, and does not detract from the golden appearance. These coating combinations with or without the intervening coating of colloidal particles are most effective in increasing the corrosion resistance of chromium-free and chromium-containing ferrous substrates that have aluminum-diffused surfaces.

Indeed they also have this desirable effect on bulk aluminum such as aluminum sheets, foil and bars, as well as on titanium. On aluminum substrates such coatings adhere exceptionally well and withstand severe deformation of the surfaces to which they are applied. However the gold color contributed by the foregoing top coatings that are free of metallic aluminum, is not provided when metallic aluminum is included in those top coating formulations. The intervening coatings of colloidal alumina and the like are not heavy enough to obscure the metallic appearance of the substrate and accordingly do not adversely affect the appearance. On the other hand those intervening layers improve the wettability of the aluminum-containing surface by the top coating.

The following are examples of the production of goldcolored highly attractive and very corrosion-resistant steel and aluminum products.

EXAMPLE II

A. Jet engine compressor blades of AISI 410 steel are subjected to aluminum diffusion coating in the manner described in Example I but with the pack held at a peak temperature of 875°F for 20 hours, and after cooling, lightly blasted with fine glass particles as described in Example I, giving an aluminum pick-up of 40 milligrams per square centimeter of ferrous surface.

B. On the lightly blasted aluminized surface there is sprayed with an air-propelled spray, a uniform very thin layer from an aqueous dispersion of 3.4% $CrO_3$;
2.4% MgO;
11% $H_3PO_4$;
5.7% leafing aluminum;
6.8% polyethylene glycol having an average molecular weight of 300 and in which the glycols range from pentamethylene glycol through heptamethylene glycol; and
0.9% para-isononyl phenylether of dodecaethylene glycol;
all percentages being by weight.

The sprayed blades are then air dried and baked at 700°F in an air over for 30 minutes to give a coating weight from this spray of 0.7 milligram per square centimeter of ferrous surface.

C. The blades coated in steps A and B have their coated surfaces given a spray coating of colloidal alumina dispersed in a 20% concentration by weight in water to which a little HCl is added to bring the pH down to about 4. A very fine spray is used to leave a light coating which after drying in air weighs 0.5 milligram per square centimeter.

D. The blades with the air-dried coatings are then given a top spray coating from an aqueous dispersion of 5.8% $CrO_3$;
4% MgO;
18.3% $H_3PO_4$; and
0.5% polytetrafluoroethylene particles about 1 micron in size;

this spray being such that upon air drying in an oven and then baking at 700°F for 30 minutes in an air oven, the final coating weighs 0.5 milligram per square centimeter.

EXAMPLE III

The coating steps of Example II are repeated but this time the workpieces are SAE 1010 steel, the diffusion pack peak temperature is 800°F, the aluminum picked up in the diffusion step is 7½ milligrams per square centimeter, the baking in steps B and D is at 900°F, and the coat weight applied in step B is 0.9 milligram per square centimeter.

EXAMPLE IV

Jet engine compressor panels of low alloy steel containing 0.5% chromium and 0.02% carbon as the only significant alloy ingredients, are given the coating treatment of Example II, this time the diffusion coating pack being held at a peak temperature of 900°F, the aluminum picked up in the diffusion being about 8 milligrams per square centimeter, the coating of step B is followed by a light blasting with very fine glass microspheres about 5 microns in diameter propelled by an air stream from a blast supplied at 5 pounds per square inch gauge, and care being taken to make sure that no significant amount of the leafing aluminum in this coating is removed during such blasting.

EXAMPLE V

Sheets of 18-8 stainless steel are given the coating sequence of steps B, C and D of Example II except that the sheets with coating B are baked at 800°F for 30 minutes and after such baking that coating weighs 1 milligram per square centimeter. Coating D is also baked at 800°F for 30 minutes with its weight being 0.7 milligram per square centimeter.

EXAMPLE VI

Plates of Type 33 aluminum were coated by the sequence of steps B, C and D of Example II, and the coated plates had a gold sheen of very attractive appearance.

EXAMPLE VII

Titanium sheets coated by the steps B, C and D of Example II were also colored with a golden shine.

The aluminum diffusion coatings produced with the aluminum halide energizer in the arrangements illustrated in Example I, are exceptionally uniform and particularly free of defects. Similar freedom from defects although with slightly less uniformity, is obtained when the retorts are not over 15 inches deep and the aluminum halide energizer is confined in porous containers imbedded in the coating pack out of contact with the workpiece and with no workpiece above or below the containers. Such porous containers can be made of stainless steel or aluminum screening as described in applications Ser. Nos. 304,220 and 357,616, the screening being rolled to make a tube, and the tube ends then crumpled to lock the turns in place. It is preferred that the containers be elongated and rather thin so they can be placed with their long axes vertical in the pack and in this way do not occupy too much horizontal space. They can then be inserted in the packs after the retorts are partially or fully packed, but to obtain best results no workpiece is placed under or above the containers, nor is any workpiece within ¼ inch, preferably not within ½ inch, laterally of the containers.

Greatest effectiveness is obtained when the containers holding the energizer are confined to a relatively small portion of the horizontal cross-section of the pack. Thus a doughnut-shaped retort 13 inches deep and having an internal diameter of 8 inches with an external diameter of 30 inches can have a set of 6 energizer containers each about ½ inch in diameter imbedded in the pack against the retort wall defining its internal diameter Alternatively a simple cup-shaped retort of the same depth and outer diameter can have similar energizer-holding containers packed in the retort in its center or in any other convenient location, as a group in close juxtaposition with each other, all the workpieces being spaced therefrom. Either hydrated or anhydrous aluminum halide can be the energizer so used, and the following example illustrates this:

EXAMPLE VIII

A toroidal SAE 1010 steel retort of rectangular section and lying on its flat side, is provided so that it has a 14 inch depth measured internally, with the pack-receiving annulus having a 6 inch interior diameter and a 32 inch exterior diameter. A quantity of diffusion coating pack is prepared from a pre-fired mixture of 18% aluminum and 82% alumina by weight, the pre-firing having been effected at 900°F from uniformly mixed particles about 40 microns in size and with 3/10% anhydrous aluminum chloride added as energizer and distributed throughout the mixture before it was pre-fired. The pre-firing was for 15 hours in a hydrogen-bathed atmosphere, and drove off about 80% of the energizer.

One-half inch layer of the pre-fired and then cooled pack is poured over the bottom of the retort and a layer of workpieces than placed over that pack layer and throughout the retort except within an inch of the retort's inner wall. Additional prefired pack is then poured over the layer of workpieces until it covers them all and reaches a height about ½ inch above them. Another layer of workpieces is then loaded in the same way as the first layer, and the layering repeated until the retort is completely filled. Five energizer containers are then prepared by rolling up two turns of aluminum screening having 200 screen wires per inch to make a tube ⅜ inch in diameter and 8 inches long. One end of each tube is crumpled, about 1/5 of the total energizer (anhydrous aluminum chloride) required for the total pack, about 0.3% by weight of the pack, is then poured into each tube through its uncrumpled end, and that end also crumpled to lock the energizer in place. The tubes are then inserted in the pack adjacent the inner wall of the retort and the retort is now ready for filing. A number of such retorts can be stacked one above the other and then fired as described in U.S. Pat. No. 3,785,854, the peak firing temperature being 875°F for 14 hours. Workpieces of greek ascoloy thus treated acquire a very uniform aluminum diffusion case about 6/10 mil thick, and the number of workpieces that must be rejected or retreated is not over 1%.

As in the energizing arrangement of Example I, essentially the same results are obtained when anhydrous aluminum bromide or iodide, or hydrated aluminum chloride, bromide or iodide is used in place of the anhydrous chloride energizer, with the aluminum content of the pack ranging from 100% down to 2%. For aluminum diffusion effected below 900°F it is preferred that at least 4% aluminum be in the pack. As disclosed in Ser. No. 304,220, a convenient amount of hydrated energizer is from 3 to 6 grams for a 6½ pound pack when the pack is first broken in as well as when the broken-in pack is subsequently used for coating.

Instead of using aluminum of relatively pure composition such aluminum can be an alloy containing significant quantities of beneficial ingredients such as silicon. A content of 12% silicon will, by way of example, improve the resistance to high temperature oxidation of ferrous metals subjected to diffusion coating by such an alloy.

The very effective protection imparted to ferrous metals containing less than 1% chromium, such as plain carbon and low alloy steels does not require more than a single layer of the chromic acid-phosphoric acid-salt-aluminum mixture, when preceded by an aluminum diffusion treatment. This is illustrated by the following example:

EXAMPLE IX

Panels of SAE 1010 steel are given the diffusion coating treatment of step A in Example II, but using anhydrous $AlCl_3$ energizer. The diffusion coating weighed 7 milligrams per square centimeter, and it was then coated by spraying on an aqueous dispersion containing the chromic acid-phosphoric acid-salt-aluminum mix in the following proportions:

| | |
|---|---|
| 1.25 moles per liter | $PO_4^{---}$ |
| 0.68 moles per liter | $Mg^{++}$ |
| 0.38 moles per liter | $CrO_4^{--}$ |
| 64.5 grams per liter | Aluminum |
| 77.0 grams per liter of the polyethylene glycol of Example II, and | |
| 10.0 grams per liter of para-isooctyl phenyl ether of tetradecaethylene glycol | |

The sprayed-on layer was dried and heated in an air oven to 900°F for 25 minutes to give a 1 milligram per square centimeter coating weight.

The thus-coated panel withstood 10 cycles of alternately heating to 1100°F for 6 hours in air, followed by 16 hours exposure to a 5% salt-spray at 95°F, without showing attack of base metal, and substantially no attack nor spalling of the coating. Similar results are obtained when aluminum ions replace the magnesium ions, as well as when the baking is at 700°F and the baked coating lightly blasted with very fine glass microspheres about 25 microns in diameter impelled by air blasted at a pressure of 5 pounds per square inch. Also the use of hydrated energizer during the diffusion coating produces the same results as the use of anhydrous energizer.

In the aluminum-containing coating mixtures, the concentration of the leafing-type aluminum particles can range from about 30 to about 150 grams per liter of mixture, and the remaining ingredients can have the concentration ranges given supra. The water in these compositions can also be replaced in whole or in part by the polyethylene glycols or by any other inert liquid in which the ingredients can be dispersed and sprayed. For combinations in which only a single chromic acid-phosphoric acid-salt layer is used such layers can advantageously weigh as much as 1.5 milligrams per square centimeter. However even such a layer containing the leafing type aluminum of the present invention and weighing only 1 milligram per square centimeter imparts excellent corrosion resistance to plain carbon and low alloy steels as well as other ferrous metals containing less than 1% chromium, when applied over an aluminum diffusion coating on the metal. This corrosion resistance is even further increased when the layer containing the leafing type aluminum has its electrical conductivity increased as by heating to 900°F or higher; or by lightly blasting it with fine non-corroding particles such as glass or ground walnut shells or the like.

Thus panels of steel containing 0.05% carbon and 0.3% titanium as the only material alloying metal, show unusually high resistance to salt spray corrosion when covered by an aluminum diffusion coat having an aluminum pick-up of 6.5 milligrams per square centimeter, over which is applied the phosphoric acid-chromic acid-salt-aluminum coating of Example IX but baked at 700°F and then given a light blasting with fine glass microspheres in a 5 psi air stream, the blasting removing about 0.1 milligram of the baked coating per square centimeter.

Although the thus protected panels show splendid corrosion resistance, their coated surfaces tend to turn white or grey after long exposure to salt spray, indicating that the aluminum in the top layer is being attacked very slowly. This whitening or greying can proceed for a considerable time before the steel is attacked, even where the coating is scratched through to the base metal. However the whitening or greying can be greatly slowed by covering the phosphoric acid-chromic acid-salt-aluminum layer with a top coating such as the combination of an air-dried colloidal alumina layer weighing 0.1 to 1 milligram per square centimeter and an overlying baked phosphoric acid-chromic acid-salt-teflon layer, weighing 0.2 to 1 milligram per square centimeter. It is preferred that the combination of layers on the aluminum diffused surface weigh not more than about 2 milligrams per square centimeter.

The coatings containing the leafing type aluminum in accordance with the present invention are electrically conductive to an appreciable degree when they have been subjected to baking of at least 900°F or when they have been burnished as by means of the fine glass blasting, or both. The greater their electrical conductivity, the greater the corrosion resistance they impart, particularly to ferrous substrates. These coatings are also smoother and more effective in thinner layers than comparable coatings containing granular aluminum as described in U.S. Pat. Nos. 3,248,251 and 3,787,305, and thus much more suitable for use in air foils, particularly of turbines.

The foregoing top coatings of chromic acid-phosphoric acid-salt formulations are also helpful when applied over aluminum diffusion coatings that are produced by the inhibited diffusion processes described in U.S. Pat. Nos. 3,257,230 and 3,690,934, as well as in U.S. patent application Ser. No. 328,378 filed Jan. 31, 1973. Those processes are generally conducted at temperatures well above 1100°F with cobalt- and nickel-based superalloys, but can also be conducted with ferrous substrates at lower temperatures, particularly to diffuse less aluminum.

In such inhibited diffusion it is desirable to use extremely fine particles of pre-fired alloys such as alloys of aluminum and chromium, or of aluminum, chromium and silicon. Particle sizes of from about 1 to about 10 microns are particularly suitable.

The separate step of pre-firing the chromium and aluminum mixture can be avoided by directly preparing such a mixture in finely divided form. To this end the magnesothermic reduction of chromium compounds such as $Cr_2O_3$ as described in French Patent No. 1,123,326 and its Addition Patent No. 70,936, can be modified by combining an appropriate quantity of alumina with the chromium compound, and such combination mixed and subjected to the magnesothermic reduction as described in those patents. This simultaneous reduction takes place at about the same temperatures and times as is shown for the reduction of the chromium compound alone and with the same equipment, producing a chromium-aluminum alloy having a particle size of about 1 micron. Residual magnesium as well as magnesium oxides present in the reduced material is removed by treatment with an excess of dilute nitric acid having a specific gravity of about 1.12 to about 1.26. Such acid will not attack chromium-aluminum alloys having as little as 16% chromium by weight, but will readily dissolve metallic magnesium as well as magnesium oxide. Crushing the alloy to a fine powder helps the acid dissolve all the magnesium rapidly. It is not essential to remove any magnesium oxide present in the reduced mixture inasmuch as this compound is essentially inert during a coating operation and does not tend to sinter or adhere to the workpieces being coated or to the other ingredients of the coating pack. Where the hot magnesothermic reaction mixture has its vapor flushed out at high temperatures to flush out the relatively volatile magnesium metal remaining after the reduction is completed, the crude reaction product can after crushing be directly used for diffusion coating. Where nitric acid washing is carried out, the washed material is rinsed with water, preferably to neutrality, filtered and dried before use.

Magnesothermic reduction can also be used in the same way to directly produce chromium-silicon, chromium-aluminum-silicon, chromium-aluminum-iron, molybdenum-silicon and tungsten-silicon alloys in the extremely finely divided form so highly desirable for diffusion coating workpieces. Silica makes a convenient source of silicon for such purposes and can be directly substituted for or added to the mixture being reduced without materially changing the reduction rate or temperature. The finely divided alloys can also be produced by magnesothermically reducing chromium, iron, molybdenum or tungsten oxides or other compounds of these metals in the presence of aluminum and/or silicon in elemental form. During such reduction the aluminum and/or silicon alloys with the metallic chromium, iron, molybdenum and tungsten as it is formed.

The following is an example of the dual reduction technique:

EXAMPLE X 1392 grams of magnesium metal were placed in a plain carbon steel retort cup 8 inches in diameter and 7 inches deep, the retort uncovered with an inverted outer inconel retort and the combination heated in a furnace under an argon atmosphere to 1700°F where it was held for 25 minutes to melt the magnesium. The molten metal was then permitted to cool, still under argon, to room temperature, when the covering retort was removed, and replaced after 104 grams powdered $Al_2O_3$ and 500 grams powdered $Cr_2O_3$ poured over the solidified magnesium. The combination was again heated under argon, this time to 1825°F for 8 hours, and cooled.

A powdery reaction product remained in the retort. It was removed from the retort, treated with excess 2 N $HNO_3$ until there was no further reaction evident, and then washed to neutrality with water. The resulting material was a chromium-aluminum intermetallic in the form of particles averaging about 1 micron in size. It analyzed 81.2% chromium and 16.6% aluminum, by weight, its yield being 91%. When mixed with alumina and ammonium chloride it gave very good aluminum diffusion coatings in the process of Canadian patent 806,618, in place of the mixture of chromium and aluminum there suggested.

Similar results are obtained when the preliminary melting of the magnesium is not effected, and where the intermetallic is used for diffusion coating steels at lower temperatures.

Other intermetallics similarly made and used have the following analyses:

| | | |
|---|---|---|
| a) | 45.5% | Al |
| | 54.5% | Cr |
| b) | 44.1% | Cr |
| | 47.7% | Fe |
| | 8.5% | Al |
| c) | 74.5% | Cr |
| | 7.0% | Al |
| | 8.5% | Si |

Alloy (c) contains some unreduced oxide, but it still is very effective for use in the inhibited diffusion process.

Obviously many modifications and variations of the present invention are possible in the light of the above teachings. It is, therefore, to be understood that within the scope of the appended claims the invention may be practiced otherwise than as specifically described.

What is claimed:

1. In the pack diffusion coating of aluminum on ferrous substrates at temperatures below 1000°F with an aluminum halide energizer, the improvement according to which the energizer is supplied only as an upper layer over the diffusion coating pack, and the pack is held in a retort cup not over 15 inches deep.

2. The combination of claim 1 in which the supplied energizer is hydrated aluminum halide.

3. The combination of claim 1 in which the diffusion is effected in a hydrogen-bathed atmosphere.

4. The combination of claim 1 in which the supplied energizer is hydrated aluminum chloride.

5. The combination of claim 4 in which the energizer layer is spaced from all the work pieces in the pack by energizer-free pack composition.

6. The combination of claim 5 in which the supplied energizer is anhydrous aluminum chloride.

* * * * *